United States Patent [19]

Rossetti

[11] Patent Number: 4,818,336

[45] Date of Patent: Apr. 4, 1989

[54] METHOD OF MAKING METAL MOLDS AND DIES

[75] Inventor: James J. Rossetti, Palmyra, Wis.

[73] Assignee: Advanced Tool Technologies, Incorporated, Lake Geneva, Wis.

[21] Appl. No.: 107,893

[22] Filed: Oct. 13, 1987

Related U.S. Application Data

[63] Continuation of Ser. No. 850,769, Apr. 11, 1986, abandoned.

[51] Int. Cl.[4] ..... C23F 1/02; B29C 47/08

[52] U.S. Cl. ..... 156/651; 156/658; 156/659.1; 427/277; 264/132; 264/293

[58] Field of Search ..... 156/658, 628, 637, 651, 156/639, 645, 650, 659.1, 664, 651; 264/293, 132, 220, 221, 222, 227; 427/277, 264

[56] References Cited

U.S. PATENT DOCUMENTS

| | | | |
|---|---|---|---|
| 3,290,192 | 12/1966 | Kelley | 156/659.1 |
| 3,891,437 | 6/1975 | Sarka | 156/659.1 |
| 4,028,455 | 6/1977 | Ueda et al. | 264/220 |
| 4,035,226 | 7/1977 | Farber et al. | 156/659.1 |
| 4,210,695 | 7/1980 | Hirono et al. | 156/659.1 |
| 4,325,779 | 4/1982 | Rossetti | 156/651 |
| 4,579,022 | 4/1986 | Kasai et al. | 156/659.1 |
| 4,594,120 | 6/1986 | Bourland, Jr. et al. | 264/221 |

*Primary Examiner*—David L. Lacey
*Assistant Examiner*—Thi Dang
*Attorney, Agent, or Firm*—Lee & Smith

[57] ABSTRACT

A method of forming a metal mold or die from a model of the mold contours. A workpiece for the mold is coated with a material which is resistant to an acidic etchant and which has a melting temperature sufficiently elevated such that the coating is generally solid. The coated workpiece is then immersed in an etchant, and a heated template is pressed against the coated workpiece, melting any portions of the coating contacted by the template. The melted portions of the coating are displaced until the template contacts the surface of the workpiece. The template is then withdrawn to permit solidification of the coating, the etchant etches any portions of the workpiece exposed by displacement of the coating, and the process is repeated until the surface of the workpiece conforms to any contouring of the surface of the template.

6 Claims, 2 Drawing Sheets

METHOD OF MAKING METAL MOLDS AND DIES

This application is a continuation of application Ser. No. 850,769, filed Apr. 11, 1986, now abandoned.

BACKGROUND OF THE INVENTION

This invention relates to formation of metal dies or molds, and in particular to a method for forming a contoured mold surface by progressively etching the surface of a workpiece until the mold configuration is formed in the workpiece.

Metal molds or dies can be formed in several different manners. The present invention relates to manufacture of molds or dies by etching techniques where an etchant, such as an acidic bath, is used to etch a metal surface progressively in order to form the mold or die. Throughout the remainder of this description, the terms 'mold' or 'die' will be used interchangeably to mean a tool formed from a workpiece and which has a contoured surface for use in the production in quantity of threedimensional products of metal, plastic or the like.

U.S. Pat. No. 4,325,779, issued on an invention of the same inventor as this application, relates to a method for forming a mold surface by etching techniques. However, in the disclosed method of U.S. Pat. No. 4,325,779, the technique is laborious, requiring removal of portions of a coating covering the mold workpiece surface, application of an etchant to etch any thus exposed metal, removal of the etchant and cleaning of the mold, reapplication of the coating to the entire mold workpiece surface, and then repetition of the procedure until sufficient depth of etching has been effected to form the mold. The method is labor intensive and quite slow due to the necessity for continual cycles of manual application and removal of the coating material and the etchant.

U.S. Pat. No. 3,290,192 discloses a method of continually forming surfaces by etching techniques. An item to be etched is immersed in an etching bath and a heated die is brought into contact with the surface of the item repeatedly in order to etch the surface. The etchant is kept relatively cool to minimize its etching capabilities, while the repeated pulsation of the die is intended to continually replenish fresh etchant between the tool face and the surface being etched. There is no coating to protect the surface being etched, requiring careful control of the temperature of the etchant and of the nature of the etchant to assure that other areas of the surface are not inadvertantly etched where etching is not desired.

SUMMARY OF THE INVENTION

The present invention comprises a method of forming a contoured surface in a workpiece in order to form a mold element therein by progessively etching a surface of the workpiece. A template is provided having a contoured surface which is a negative pattern of the contoured surface of a mold to be formed in the workpiece. A meltable, wax-like coating is applied to the workpiece, the coating being resistant to any etchant used and having a melting temperature sufficiently elevated such that the coating, after application to the workpiece, is generally solid. The coated workpiece is then immersed in the etchant, and the template is heated to at least the melting temperature of the coating. The heated template is then pressed against the coated workpiece to melt those selected portions of the coating contacted by the template. The melted portions are displaced by the template as the highest portions of the contoured surface of the template approach and contact the workpiece. After such contact, the warm template is withdrawn from the coated workpiece sufficiently to permit re-solidification of the locally melted coating. The etchant then etches those portions of the workpiece which are exposed by the displacement of the coating. The process is repeated without any extrinsic manipulation of the coating until the surface of the workpiece conforms to the contoured surface of the template.

In accordance to the preferred embodiment of the invention, the coating for the workpiece is a type of material which, when passing from the solid state to the liquid state, softens over a range of temperatures before melting. The workpiece may also be heated to incipient softening temperature of the coating before the heated template is pressed against the coated workpiece.

The coating material preferably has a melting temperature sufficiently elevated that the coating is solid after application to the workpiece at, say, room temperature. The coating may comprise a wax, such as paraffin, which is heated to its melting temperature before application to the workpiece. Depending on the nature of the coating desired, tar is added to the wax, and if desired, rosin is also added. A suitable mixture may be 10 parts wax, 1 part tar and 1 par rosin.

The template is formed from a model of the three-dimensional product which is intended to be produced by the mold formed in the workpiece. A suitable material in liquid form is first poured over the model, with the liquid material subsequently hardening to form a temporary mold for the template. The model is then removed from the temporary mold, and a hardenable material is cast into the temporary mold to form the template. If the material of the temporary mold is susceptible to adhering to the model, a release agent is aplied to the model before the liquid material is poured thereover to form the temporary mold.

The etchant may be an acid of sufficient strength to etch the steel forming the workpiece. Many suitable solutions may be used, such as a mixture of 10 parts urea, 4 parts sulfuric acid, 7 parts nitric acid and one part muriatic acid, all in commercially available concentrations. Suitable etchants are well known in the engraving field.

The template must be formed of a material which flows easily in its liquid state in order to conform to its temporary mold and form a template which is an exact duplicate of the model, but which will not soften or deform in any manner when working temperatures are applied thereto in order to melt the coating as the contoured surface is formed in the workpiece. Preferably, the template is made of epoxy or a similar resin, which may be filled with finely divided aluminum or copper in order to enhance the thermal conductivity of the body of the template for uniformity of temperature. Such metals or powered carbon may also be used to render the template material electrically conductive sufficiently to heat the template by electrical resistance during the progressive formation of the mold surface.

BRIEF DESCRIPTION OF THE DRAWINGS

The invention is described in greater detail in the following description of an example embodying the best mode of the invention, taken in conjunction with the drawings, in which.

DESCRIPTION OF EXAMPLES

EMBODYING THE BEST MODE OF THE INVENTION

Figure 1:
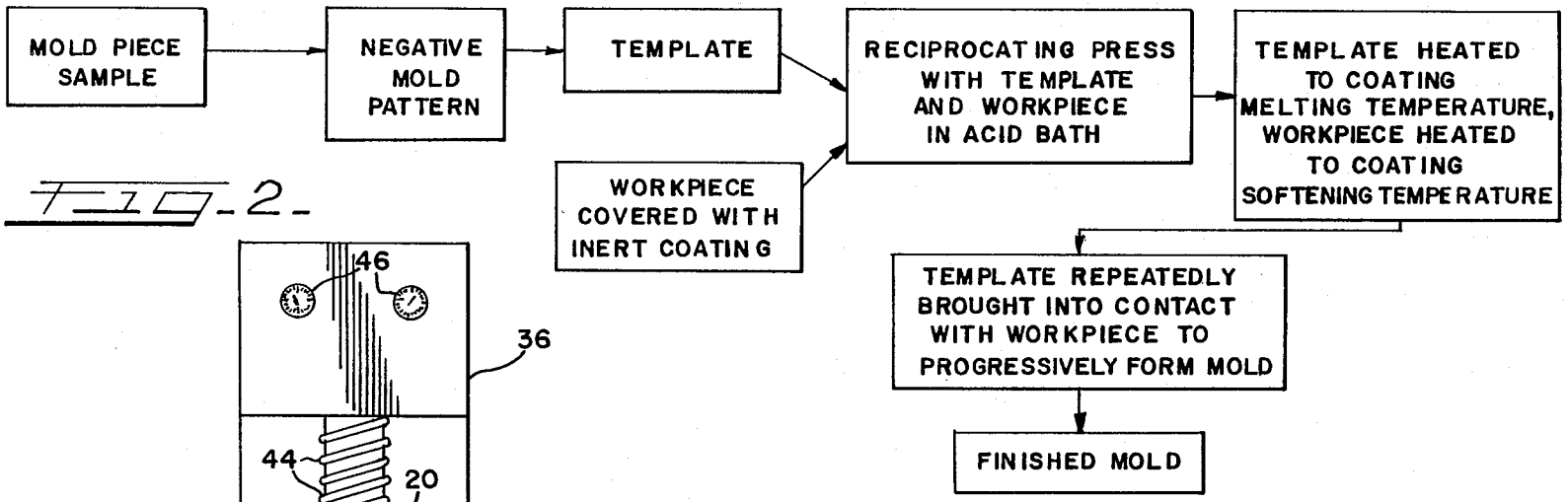
FIG. 1 is a block diagram outlining the novel method of the invention.

FIG. 1 sets forth in block form the steps taken in accordance with the process of the invention. The invention is intended to be utilized to duplicate a sample of an object to be molded. As illustrated in Figure 1, that object is first selected and a negative mold pattern is then formed. Preferably, the mold pattern is made of a liquid material, such as silicone rubber, which readily conforms to the surface of the sample and, upon hardening, is readily removable from the sample.

After the mold pattern has been made, a template is made by pouring in liquid form a hardenable material, such as epoxy resin, into the mold pattern. The hardenable material must be inert to any etchant used, and must withstand the elevated temperatures applied to it when the mold forming process proceeds. Because the process requires the template to be warm, the epoxy or other resin used to form the template may be doped with aluminum, copper, or powdered or finely divided carbon to render the body of the template thermally and/or electrically conductive sufficiently to aid in the heating of the template. If necessary, the template is then embedded upon a supporting material so that it can be mounted in a reciprocating press.

The workpiece which is to be formed into the die or mold is coated on all exposed surfaces by a suitable composition which is inert to the etchant. The coating must also have a melting temperature sufficiently elevated that it is solid at ambient temperatures yet readily melted during the mold forming process. As explained above, a suitable coating is composed of a wax, such as paraffin, to which other materials, such as tar and rosin, can be added to alter the melting properties of the paraffin. In addition, if tar is added to the wax, the tar aids in adherence of the coating to the workpiece.

After the template and the coated workpiece are prepared, they are installed in a reciprocating press such as that illustrated in Figure 2, described below. The workpiece is immersed in an acidic etchant bath, while the template is installed in a reciprocating ram such that it can be brought into periodic contact with the coated workpiece.

The template is heated to a least the melting temperature of the coating for the workpiece such that upon contact of any part thereof with the coating, the coating will melt at the locations of such contact. Depending upon the properties of the coating itself, the workpiece can be heated to the incipient softening temperature of the coating to facilitate the process of the invention. If the coating is soft at ambient temperatures, heating of the workpiece is unnecessary.

The template is repeatedly brought into contact with the coated workpiece and withdrawn in order to progressively form the mold. Perferably, a rate of contact on the order of 20 per minute is adequate for rapid and accurate formation of the mold in the coated workpiece. After a suitable length of time, the mold is completed and is removed from the acidic etchant bath.

Figure 2:
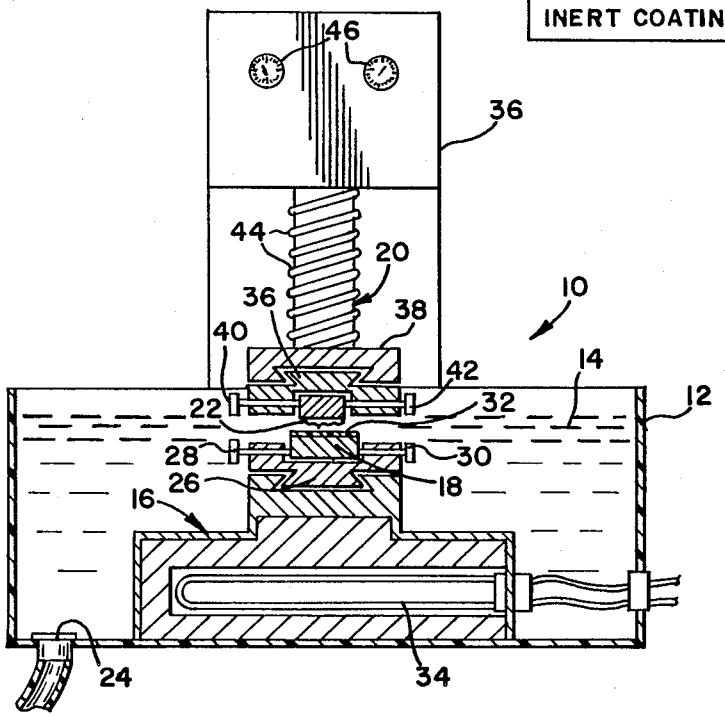
FIG. 2 is an elevational view, partially in cross section, of an apparatus used to practice the method of the invention.

FIG. 2 illustrates one form of an apparatus 10 for performing the method of the invention. Primary components of the apparatus 10 are a tank 12 filled with a etchant 14, a support 16 for the coated workpiece 18, and a ram 20 carrying the template 22.

The tank 12 is sufficiently large to hold an adequate quantity of the etchant 14 for completion of the process of forming a mold in the workpiece 18. A convenient drain 24 permits rapid withdrawal of the etchant 14 without siphoning or removal of the tank 12.

The support 16 is made of a material which is inert to the etchant 14. The support 16 includes a removable block 26 carrying a pair of clamps 28 and 30 for maintaining the workpiece 18 in place.

As explained above, it is preferred that the coating 32 of the workpiece 18 be heated to the softening point. One means of doing so is shown in FIG. 2, in which a heating element 34 is installed in the support 16. Temperature of the heating element is controlled externally of the tank 12 (means not illustrated) as necessary to assure the maintenance of a proper temperature for the coating 32. As explained above, should the coating 32 be soft at ambient temperatures, use of the heating element 34 is unnecessary.

The ram 20 is installed within a housing 36 for reciprocating movement toward and away from the stationary workpiece 18. The ram 20 includes a removable block 36 for carrying the template 22. As shown, the template 22 is affixed to or embedded upon a support element 38 which is held in place in the block 36 by means of a pair of adjustable clamps 40 and 42. It is necessary to maintain the temperature of the template 22 at at least the melting temperature of the coating 32. A heat coil 44 may be installed on the ram 20, or other heating sources may be utilized as desired to maintain the proper working temperature of the template 22.

Gauges 46 may be provided as necessary for monitoring the temperature of the various elements of the apparatus 10. Other gauges, switches and suitable operational elements may be employed in the apparatus 10 to facilitate its operation and performance of the method of the invention.

Figure 3:
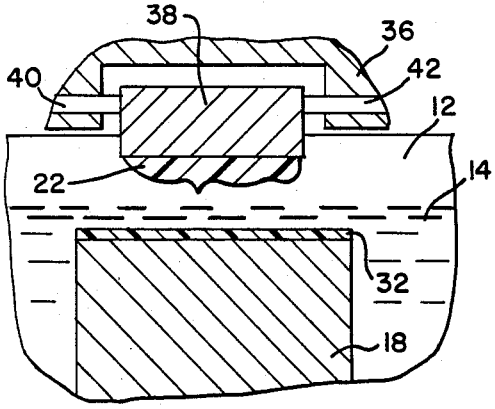
FIGS. 3 through 6 illustrate progressively the steps of forming a mold according to the invention.
Figure 4:
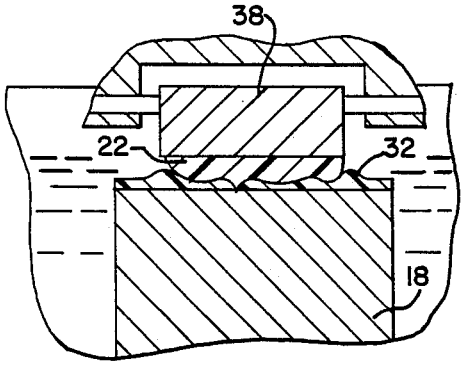

FIGS. 3 through 7 are enlarged partial cross sectional views of a portion of the apparatus 10 showing the various steps of formation of a mold in the workpiece 18. FIG. 3 illustrates in enlarged fashion a portion of the apparatus 10 in the position shown in FIG. 2, with the template 22 poised above the as-yet uncontacted workpiece 18 with its undisplaced coating 32. The coating 32 has illustrated across only the top face of the workpiece 18, it being evident that actually any exposed portions of the workpiece 18 would be covered with the coating 32 or otherwise appropriately protected from attack by the etchant 14.

Figure 5:
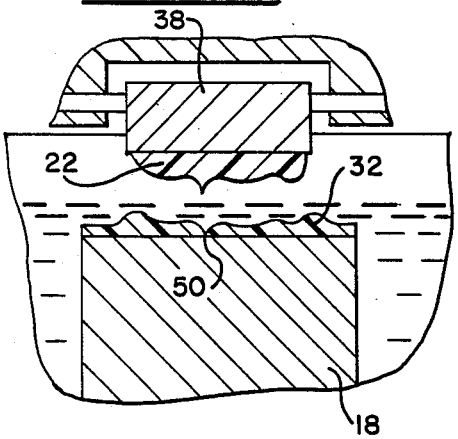
Figure 7:
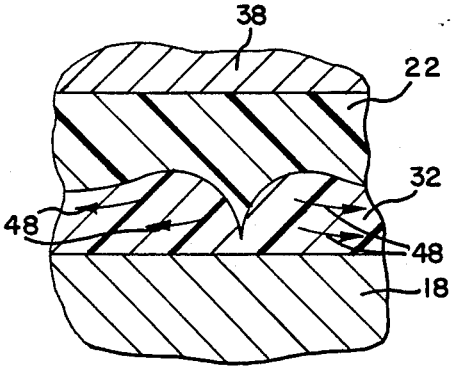
FIG. 7 is an enlarged view of the initial formation process illustrating displacement of the coating material.

With the template 22 heated to the melting temperature of the coating 32, and with the coating 32 heated to its softening temperature, if necessary, the ram 20 is lowered so that the template 22 engages the coating 32. As best shown in FIG. 7, arrows 48 illustrate local displacement of the coating 32 as the ram 20 is lowered and the coating material is melted. When the template 22 has contacted the workpiece 18 through the coating 32, the ram 20 is then raised as shown in Figure 5, to permit the etchant 14 to etch any exposed surfaces of the workpiece 18. In the illustrated embodiment of the invention shown in FIG. 5, because the template 22 initially contacts the workpiece 18 at only one point, etching has begun at only that one location 50. Because the template 22 has been raised above the workpiece 18 and coating thereon, any portions of the coating 32 that were melted and displaced resolidify and remain in place until contacted again by the heated template 22.

Figure 6:
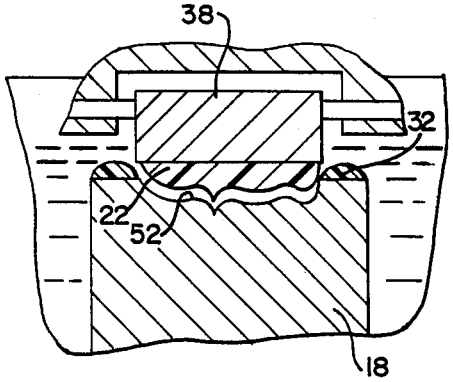

FIG. 6 illustrates the formation of a mold cavity 52 within the workpiece 18 after numerous successive reciprocations of the ram 20. As illustrated, the coating 32 has been displaced to the sides of the template 22, and the mold cavity 52 has been formed in an opposite image to the surface configuration of the template 22.

Figure 8:
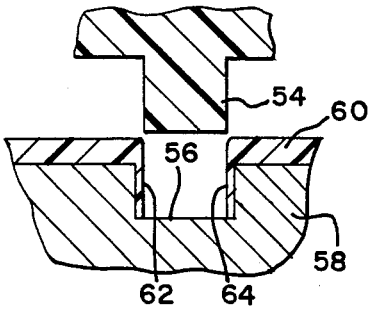
FIG. 8 is an enlarged cross sectional illustration, somewhat exaggerated, illustrating coating of the vertical sides of a portion of the mold during the mold forming process in order to prevent etchant undercutting.

Of particular concern during the etching process is avoiding undercutting of any depressions formed in the workpiece which have essentially vertical sides. Illustrated in FIG. 8 is the means by which the invention avoids any such undercutting. FIG. 8 illustrates the forming process according to the invention, after some period of time, in which a template 54 has formed a cavity 56 within a workpiece 58 by displacement of a coating 60 in precisely the same manner as described above.

As the template 54 continually contacts the workpiece 58 and displaces the coating 60, the cavity 56 is formed. Because the etchant (not illustrated) uniformly etches the material of the workpiece 58, the cavity 56 is formed slightly wider than the width of the template 54. Thus, when the template 54 returns into contact with the workpiece 58, the template 54 remelts the coating 60 and thin portions 62 and 64 of the coating 60 flow into the space between the outer surface of the template 54 and the inner wall of the cavity 56. The thicknesses of the coating portions 62 and 64 have been exaggerated somewhat for illustration purposes. As will be seen, the coating portions 62 and 64 remain in place during further reciprocations of the template 54, assuring that the side walls of the cavity 56 are not undercut thoughout the remainder of the mold formation process.

The reciprocating cycle of ram 20 is activated at maximum practical frequency to speed formation of the mold cavity 52 within the workpiece 18. Twenty reciprocations per minute have been found to be an adequate and feasible pulsation rate of the ram 20. The pulsation rate necessarily will be affected by the nature of the etchant 14, the type of steel or other material composing the workpiece 18, the temperature, if any, to which the coating is heated, and the ambient temperature of the etchant 14. Also, since etchant brought to bear at the points of contact of the template may be present upon the surfaces of the template or even absorbed to some extent in the surface portions of the body of the template, the nature of the material of which the template is composed also affects the efficienty of the etchant corrosion process.

It will be understood that a variety of materials, other than those specified by way of example, may be used for the temporary mold, for the template, for the workpiece and for the inert coating therefor, and for the etchant solution. A variety of workpiece material and etchant systems are well known in the engraving and related arts. In addition to steel, metals such as copper, brass, zinc, aluminum and magnesium may be used for the mold workpiece and etchants employed will be selected for their corrosion properties with respect to the workpiece material used. Acidic etchants are most generally used, but an alkaline solution would be usable with aluminum.

ACHIEVEMENT OF THE INVENTION

The herein disclosed method of making dies for the production in quantity of metal copies of an original, as by die casting, requires no skilled craftsman and a minimum of labor. The process is susceptible to automation in that, once set up, the process of progressive corrosion by an etchant to form the die can be programmed and carried out to completion without intervention by an attendant. The method may be used to make molds for the production of plastic products by injection molding processes. As compared with procedures heretofore employed for making dies and molds, the costs are reduced by more than half in most cases. With such reductions in tooling costs, products can now be made which could not be made and marketed heretofore because of prohibition tooling costs.

Various changes can be made to the invention without departing from the spirit thereof or scope of the following claims.

What is claimed is:

1. A method of forming a contoured surface in a workpiece in the form of a metal mold or die by etching the surface thereof comprising the steps of;

a. providing a template having a contoured surface which is a negative pattern of the contoured surface to be formed in the workpiece, b. applying a meltable coating to the workpiece, the coating being resistant to an etchant and having a melting temperature such that the coating is generally solid after application to the workpiece, c. immersing the coated workpiece in an etchant, d. heating the template to at least the melting temperature of the coating, e. pressing the heated template against the coated workpiece and melting any portions of said coating contacted by the template, f. only displacing the melted portions of said coating as the contoured surface of the template moves into contact with the workpiece, g. withdrawing the template from the coated workpiece to permit resolidification of any melted coating, while leaving any locations of the workpiece contacted by the contoured surface of the template essentially free of said coatings and exposing portions of the workpiece without withdrawing any coating with the template;

h. permitting the etchant to etch said portions of the workpiece exposed by displacement of the coating and i. repeating steps (e) through (h) until the surface of the workpiece conforms to the contoured surface of the template.

2. The method according to claim 1 in which the coating softens before melting, and including the step of heating the workpiece to the softening temperature of the coating before step (e).

3. The method according to claim 1 including forming the template by the steps of providing a model for the template, pouring a liquid material over the model which subsequently hardens to form a temporary mold for the template, removing the model from the temporary mold, and casting a hardenable material in the temporary mold to form the template.

4. The method according to claim 3 including the step of applying a release agent to the model before applying the liquid material to form the temporary mold.

5. The method according to claim 1 including forming the coating by the steps of melting a wax, melting a tar, and mixing the tar into the wax to form a mixture which, when hardened, can be softened before melting.

6. A method of forming a contoured surface in a workpiece in the form of a metal mold or die by progressively etching the surface thereof, comprising the steps of;

a. providing a template having a contoured surface which is a negative pattern of the contoured surface to be formed in the workpiece, b. applying a meltable coating to the workpiece, the coating being resistant to an etchant and having a melting temperature such that the coating is generally solid after application to the workpiece, the coating being capable of softening before melting, c. immersing the coated workpiece in an etchant, d. heating the template to at least the melting temperature of the coating, e. heating the workpiece until the coating softens, f. pressing the heated template against the coated workpiece and melting any portions of said coating contacted by the template, g. only displacing the melted portions of said coating until the contoured surface of the template contacts the workpiece, h. withdrawing the template from the coated workpiece to permit solidification of any melted coating while leaving any locations of the workpiece contacted by the contoured surface of the template essentially free of the coating and exposing portions of the workpiece without withdrawing any coating with the template, i. permitting the etchant to etch said portions of the workpiece exposed by displacement of the coating, and j. repeating steps (e) through (i) until the surface of the workpiece conforms to the contoured surface of the template.

* * * * *